US006731900B2

(12) United States Patent
Takenaka et al.

(10) Patent No.: US 6,731,900 B2
(45) Date of Patent: May 4, 2004

(54) FIXING AND IMAGE FORMING DEVICES COMPRISING THIN HEATED SHEETS

(75) Inventors: Kohta Takenaka, Kanagawa-ken (JP); Masahiko Kamijoh, Kanagawa-ken (JP); Hidehiko Fujiwara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/210,114

(22) Filed: Aug. 2, 2002

(65) Prior Publication Data

US 2003/0026632 A1 Feb. 6, 2003

(30) Foreign Application Priority Data

Aug. 3, 2001 (JP) ..... 2001-235852

(51) Int. Cl.[7] ..... G03G 15/20
(52) U.S. Cl. ..... 399/328; 219/216
(58) Field of Search ..... 399/320, 328, 399/330, 331, 332; 219/216; 432/60

(56) References Cited

U.S. PATENT DOCUMENTS 4,860,047 A * 8/1989 Pirwitz ..... 219/216 X
5,058,877 A 10/1991 Fujiwara et al.
5,298,952 A 3/1994 Kamijo et al.
5,315,357 A 5/1994 Kamijo et al.
5,349,425 A 9/1994 Kamijo et al.
5,809,389 A * 9/1998 Tamura et al. ..... 399/330 X
6,151,466 A 11/2000 Fujiwara
6,542,712 B2 * 4/2003 Kimijo et al. ..... 399/328

FOREIGN PATENT DOCUMENTS

JP 7-45357 2/1995
JP 11-296011 10/1999
JP 2001-29331 1/2000

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing device is provided, which has a fixing roller and a sheet. A recording paper where a toner image has been transcribed thereon is passed through a nip portion between the fixing roller and the sheet. By pressing and heating, the toner image is fixed on the recording paper. A heating line is wound on a surface opposite to a sheet's surface that is in contact with the fixing roller. By applying a power source to the heating line, the sheet is heated. When the recording paper enters the nip, the cause of the temperature suddenly lowering can be prevented.

6 Claims, 5 Drawing Sheets

FIXING AND IMAGE FORMING DEVICES COMPRISING THIN HEATED SHEETS

CROSS-REFERENCE TO RELATED APPLICATION

This application claims the priority benefit of Japanese application serial no. 2001-235852, filed on Aug. 3, 2001.

BACKGROUND OF THE INVENTION

1. Field of the Invention

This invention relates in general to a fixing device and an image forming device, which can be used in a facsimile device, a printer, a copier, or a multi-function machine with the above functions.

2. Description of Related Art

FIG. 7 is a side view showing an internal structure of a conventional fixing device. The item 100 is a fixing roller. A pressing roller 101 is pressed to be in contact with the fixing roller 100. A fixing heater 102 is arranged inside the fixing roller 100 for heating the fixing roller 100. A temperature detecting device 103 is used for detecting the temperature of the fixing roller 100. A separation claw 104 is used for separating the recording paper wound on the fixing roller 100 from the fixing roller 100. A cleaning pad 105 is in contact with the fixing roller 100 for cleaning the fixing roller 100. A cleaning pad holder 106 is used for supporting the cleaning pad 105. A cleaning pad invasion-regulating unit 107 is installed at a downstream side of the rotational direction of the fixing roller 100 with respect to the cleaning pad 105. An entrance guiding plate 108 is installed at a recording paper entrance of the fixing device 100. A paper-ejecting roller is installed at a recording paper exit of the fixing device 100.

The recording paper which the toner image has been transcribed thereon enters a nip portion between the fixing roller 100 and the pressing roller 101 through the entrance guiding plate 108. By pressing and heating at the nip portion, the toner image is fixed on the recording paper, and then the recording paper is ejected through a paper-ejecting roller 109. When the recording paper passes the nip portion, the toner attached on the fixing roller 100 is removed by the cleaning pad 105.

The surface temperature of the fixing roller 100 is detected by the temperature detecting device 103. According to a detected result of the temperature detecting device 103, a heating control of the fixing heater 102 is performed by a controlling device (not shown).

Conventionally, an infrared heater or a halogen heater is used as the fixing heater 102 in the fixing device, and a structure constituted of the fixing roller 100 and the pressing roller 101 pair is most common. The pressing roller 101 is a structure that is made by forming silicon rubber on a core bar and then a mold-releasing layer (such as Teflon, registered Trademark) is formed on the silicon rubber, so that the heat capacity of the pressing roller 101 becomes larger. At the beginning of heating, the pressing roller 101 does not get warm easily, causing incomplete fixing problems. Furthermore, there is also a demerit that parts have high cost. In addition, in order to assure a suitable nip width of the nip portion between the fixing roller 100 and the pressing roller 101, a large pressing force (pressure) is required. Because of the pressure, stress will act on the recording paper, causing fixing wrinkle problems.

Instead of the pressing roller 101, a nip portion is formed by pressing a sheet to be in contact with the fixing roller 100.

For example, a fixing device, where a non-fixed image is fixed on the recording paper by making the recording paper pass the nip portion, is well studied and researched. By the above structure, the sheet can be easily warmed up, and the nip width can be also assured.

However, regarding the fixing device using the sheet material, the heat capacity of the nip portion is small. Therefore, when the recording paper enters the nip portion, the heat will dissipate suddenly. At this time, the temperature detected by a thermistor might cause the temperature at the nip portion to be lowered and incomplete fixing might occur at the rear end of the recording paper because the position of the thermistor is located outside the nip portion and the response time of the detection is slow.

SUMMARY OF THE INVENTION

According to the foregoing description, an object of this invention is to provide a fixing device and an image forming device. The fixing device is composed of a heat conducting unit and a sheet. When a recording paper enters a nip portion, the heat from the sheet being suddenly dissipated can be prevented.

According to the objects mentioned above, the invention provides a fixing device, comprising a heat conducting unit, having a heating source, and being heated by the heating source; and a sheet that is in contact with and presses the heat conducting unit. One end of the sheet is mounted on a fixing frame that is located at an upstream side of a transporting direction of a recording paper, and the other end of the sheet is in contact with the heat conducting unit under a pressing status. When the recording paper onto which a toner image has been transcribed is passed through a nip portion between the sheet and the heat conducting unit, by pressing and heating, the toner image is fixed on the recording paper. Furthermore, a heating unit of line shape is laid on a back surface of the sheet at a region in the vicinity of the nip portion. According to the above structure, because the sheet is heated by the heating unit, the fixing device can be in a fixable status quickly. Additionally, when the recording paper passes the nip portion between the heat conducting unit and the sheet, the temperature of the nip portion can be prevented from being suddenly reduced.

In the above fixing device, the heating unit can be laid parallel to a transporting direction of the recording paper. According to this structure, the strength of the sheet becomes robust and the pressure against the heat conducting unit can become more stable. Furthermore, because the central portion of the sheet can be bent in the up-and-down direction, the sheet can be changed to a suitable shape to meet the shape of the heat conducting unit.

Alternatively, the heating unit can be laid in a grid shape. According to this structure, the strength of the entire sheet becomes more robust and the pressure against the heat conducting unit can become more stable.

The invention further provides an image forming device, comprising a fixing device that has the aforementioned structure and features. According to the above structure, the fixing property can be improved

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The embodiment of the invention is described in detail with reference of the attached drawing.

Figure 1:
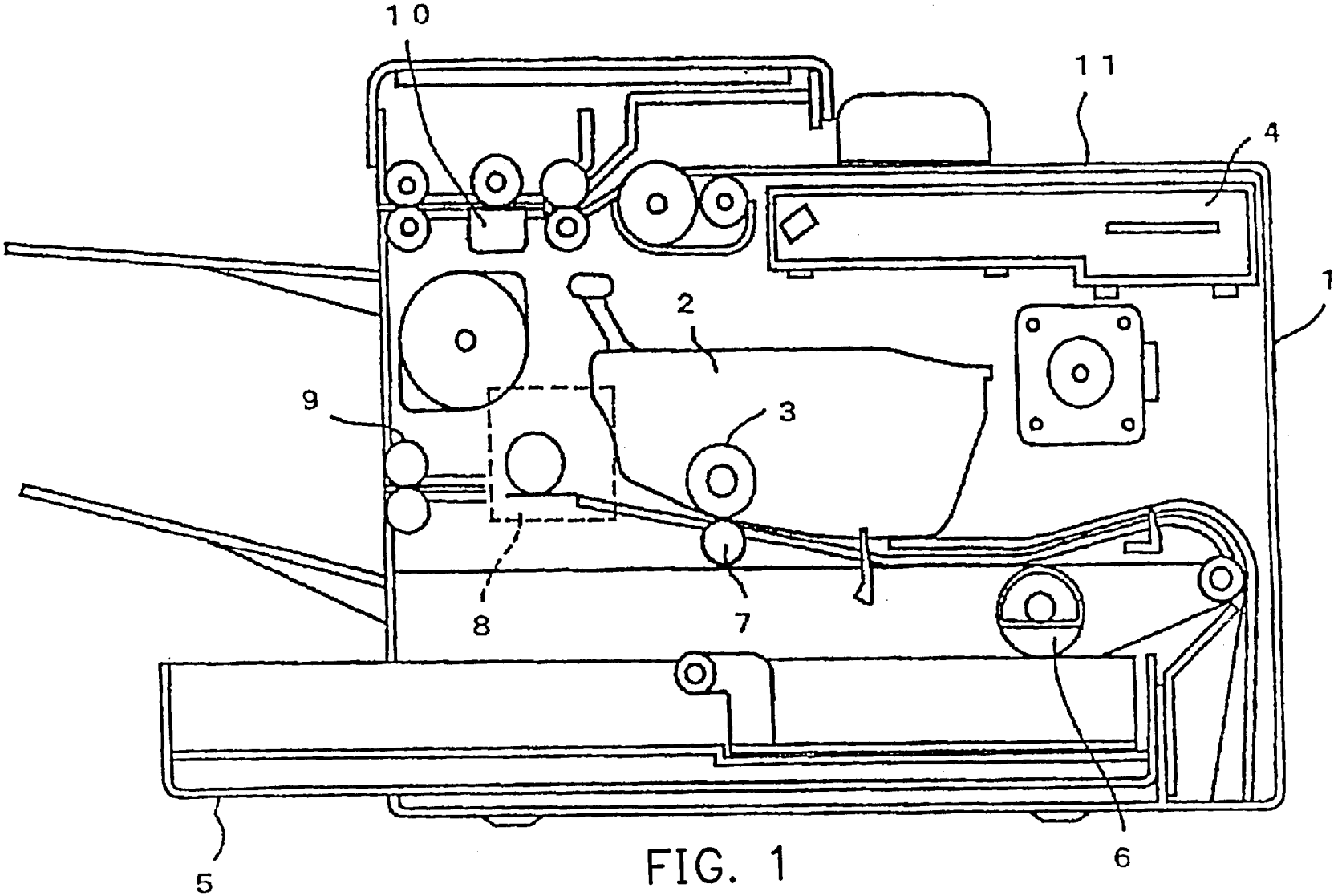
FIG. 1 is a side view showing an internal structure of a facsimile apparatus that has a fixing device and an image forming device.

FIG. 1 is a side view showing an internal structure of a facsimile apparatus that has a fixing device and an image forming device. The facsimile apparatus is composed of a facsimile main body 1, a process cartridge 2, a photo-sensing unit 3 having the process cartridge 2, an optical writing device 4, a paper-feeding cassette 5 storing recording paper, a paper-feeding roller 6 for feeding the recording paper from the paper-feeding cassette 5, a transcribing roller 7, a fixing device 8 for fixing a toner image on the recording paper, an paper rejecting roller 9, a sealed sensor 10, and a document stage 11 formed above the facsimile main body 1. The process cartridge 2 contains various processing devices for performing the image formation by the electronic photographic process, and is detachable from the facsimile main body 1. The optical writing device 4 makes the photo-sensing unit 3 scan by a laser beam that is modulated based on image data. The transcribing roller 7 is in contact with the photo-sensing unit 3 for transcribing the toner image formed on the photo-sensing unit 3 to the recording paper.

The document set on the document stage 11 is passed through the sealed sensor 10 by a transferring system, and then ejected to external. When the document passes the sealed sensor 10, the image on the document is optically read by the sealed sensor 10. The image data, which is read by the sealed sensor 10 or input from external, is transmitted to the optical writing device 4. Based on the image data, the optical writing device 4 emits a modulated laser beam to the surface of the uniformly charged photo-sensing unit 3, so that an electrostatic latent image is formed on the surface of the photo-sensing unit 3. Then, toner is made to adhere to the electrostatic latent image to form a toner image, and the toner image is transcribed onto the recording paper by the transcribing roller 7. By pressing and heating using the fixing device 8, the toner image is fixed on the recording paper, and the recording paper is ejected by the paper-ejecting roller 9.

Figure 2:
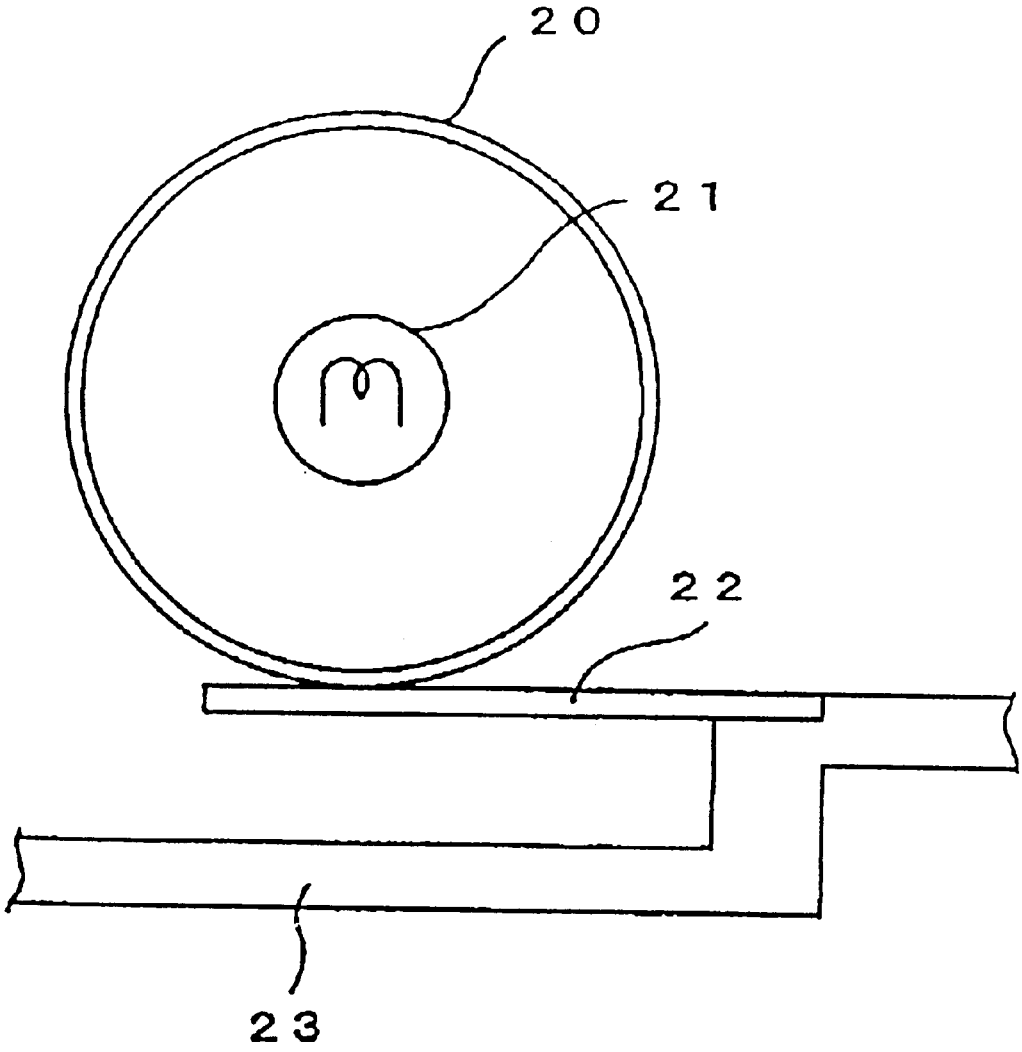
FIG. 2 is a side view substantially showing the structure of the fixing device.
Figure 3:
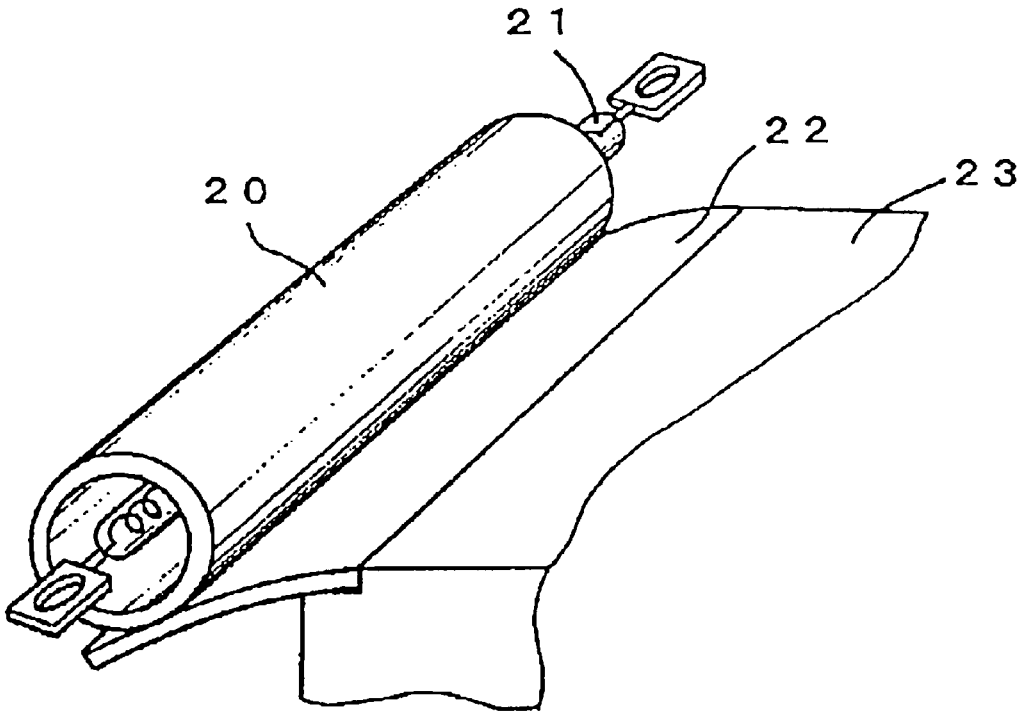
FIG. 3 is a perspective view of FIG. 2.

FIG. 2 is a side view substantially showing the structure of the fixing device 8. FIG. 3 is a perspective view of FIG. 2. The fixing device 8 consists of a cylindrical fixing roller 20, a fixing heater 21, a sheet 22, and a fixing frame 23. The fixing heater 21 is arranged inside the fixing roller 20 for heating the fixing roller 20. The sheet 22 is in contact with the fixing roller 20 and therefore presses against the fixing roller 20. The fixing frame 23 is used to affix one end of the sheet 22 so as to support the sheet 22 in a cantilever manner.

Figure 4:
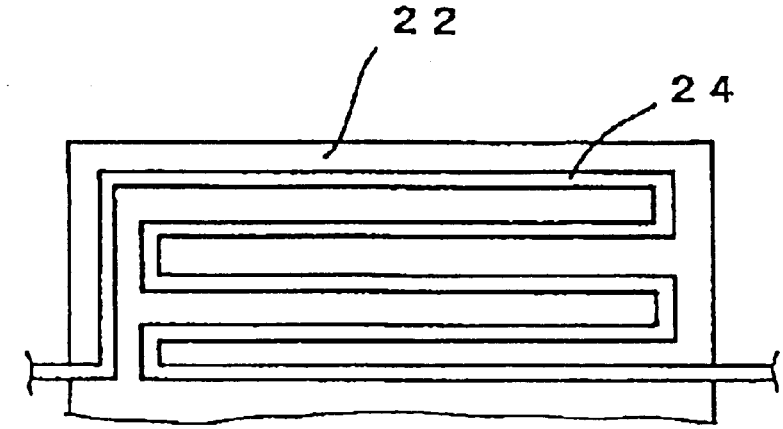
FIG. 4 shows a back surface of a sheet.

FIG. 4 shows a back surface of the sheet 22, in which item 24 is a heating line. As shown in FIG. 4, the heating line 24 is wound on the back surface, i.e., opposite to the surface in contact with the fixing roller 20, of the sheet 22. The heating line 24 is a single line 22, and is straightly extended from an end in the longitudinal direction of the sheet to the other end, at which the heating line 24 is bent and then the heating line 24 is straightly extended again from the other end to the first end. By alternatively repeating the above manner, the heating line 24 is arranged on the back surface of the sheet 22 so that the lines parallel to the longitudinal direction of the sheet 22 are arranged in parallel.

The timing to apply a power to the heating line 24 can be at a time when the image forming device is powered on, within an interval that the temperature of the fixing roller 20 is raised from a warm-up status to a fixable temperature, or an interval that the recording paper passes the nip portion between the fixing roller 20 and the sheet 22.

According to the above structure, it is possible to make the fixing device 8 be in a fixable status quickly. Furthermore, when the recording paper passes a nip portion between the fixing roller 20 and the sheet 22, even though the sheet 22 is cooled by the recording paper, the temperature of the nip portion can be maintained at a fixable temperature.

Figure 5:
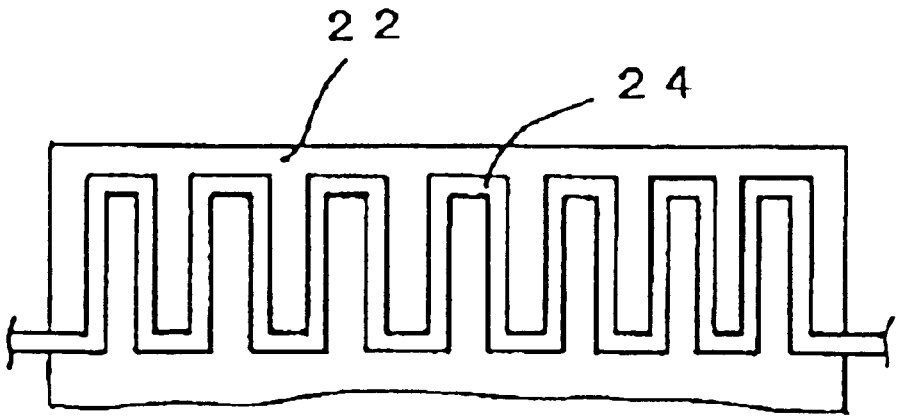
FIG. 5 shows a back surface of a sheet according to a second embodiment of the invention.

FIG. 5 shows a back surface of the sheet 22 according to a second embodiment of the invention. In FIG. 4, as regarding the back surface of the sheet 22 in the first embodiment, the heating line 24 is wound on the back surface of the sheet 22 in a manner such that the lines parallel to the longitudinal direction of the sheet are arranged in parallel. With respect to this, the second embodiment in FIG. 5 arranges the heating line 24 on the back surface of the sheet 22 in a manner that lines parallel to the recording paper transporting direction are arranged in parallel.

In the fixing device using the sheet 22, the nip pressure at each portion in the longitudinal direction of the fixing roller 20 is easily varied according to the shape of the fixing roller 20. For example, when the fixing roller is a drum type, because the pressing roller is made of an elastic body, the nip pressure is undoubtedly acted on the central portion, but applying the pressure by the sheet 22 is difficult to apply the nip pressure to the central portion, so that the fixing property is reduced.

As shown in FIG. 5, by winding the heating line 24 on the back surface of the sheet 22, the strength of the sheet 22 becomes robust and the pressure against the fixing roller 20 can become more stable. Furthermore, because the central portion of the sheet 22 can be bent in the up-and-down direction, the sheet 22 can be changed to a suitable shape to meet the shape of the fixing roller 20.

Figure 6:
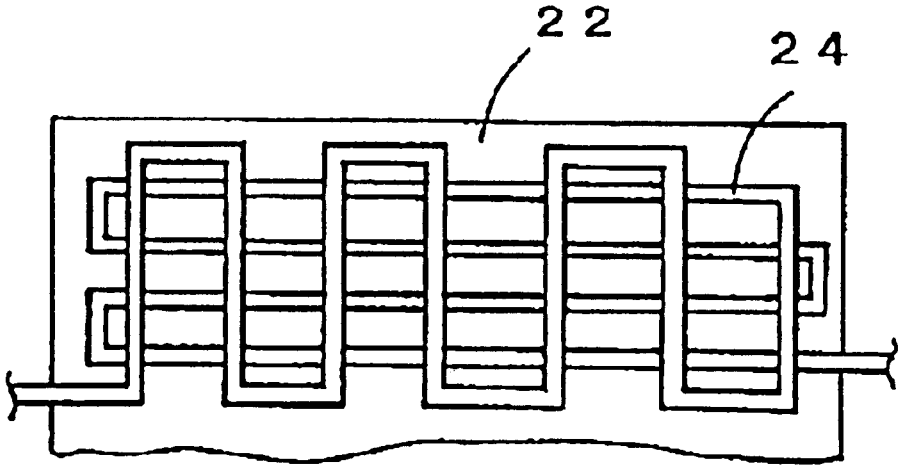
FIG. 6 shows a back surface of a sheet according to a third embodiment of the invention.
Figure 7:
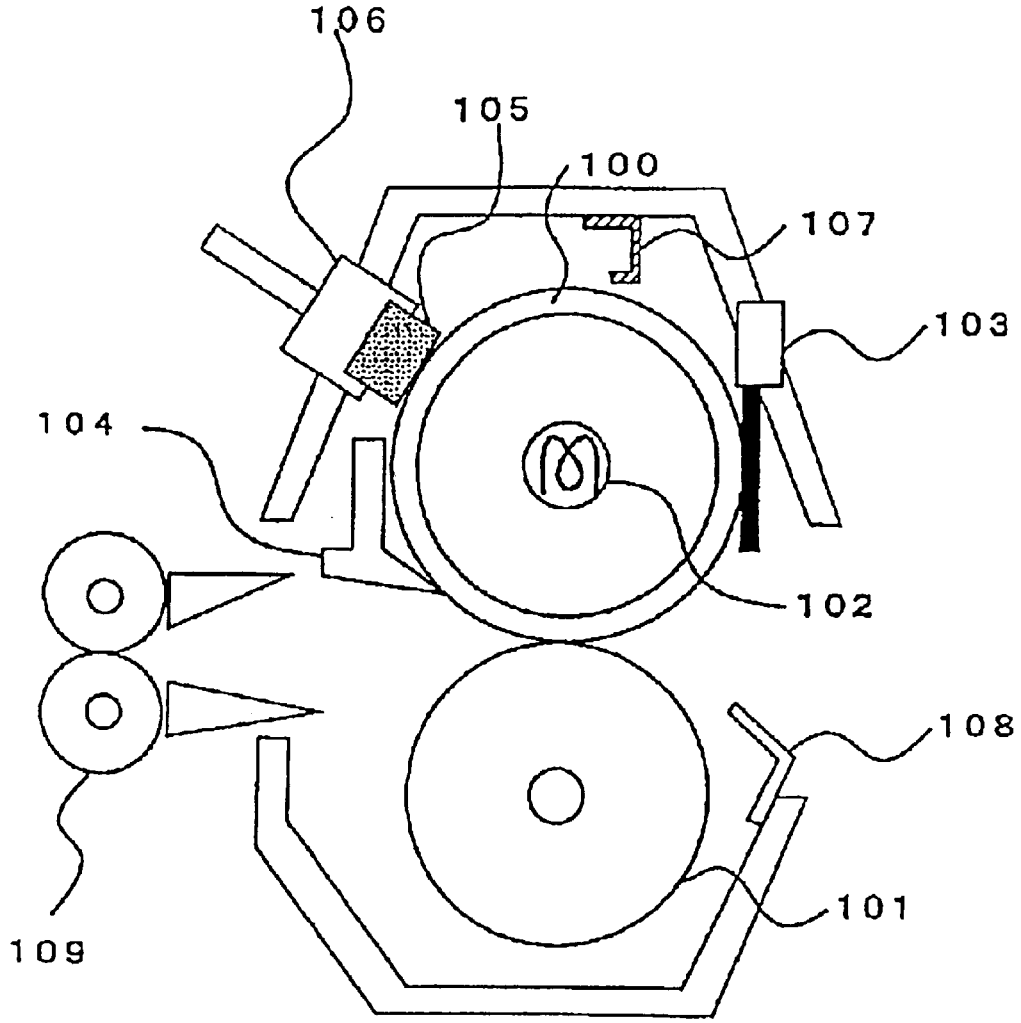
FIG. 7 (PRIOR ART)
FIG. 7 is a side view showing an internal structure of a conventional fixing device.

FIG. 6 shows a back surface of the sheet 22 according to a third embodiment of the invention. First, in the third embodiment, as the first embodiment in FIG. 4, the heating line 24 is arranged on the back surface of the sheet 22 in the manner that the lines parallel to the longitudinal direction of the sheet 22 are arranged in parallel. Next, as the second embodiment in FIG. 5, the same heating line 24 is further wound on the back surface of the sheet 22 in the manner that lines parallel to the recording paper transporting direction are arranged in parallel. In this way, as shown in FIG. 6, the heating line 24 is wound in a grid shape on the back surface of the sheet 22.

According to the above structure, the strength of the entire sheet 22 becomes robust. Additionally, the pressure against the fixing roller 20 can become more stable.

In addition, the foregoing embodiments describe a fixing device 8 whose sheet 22 is made to contact with fixing roller

20 by pressure. However, fixing devices of other types can be also suitable for the invention.

For example, the sheet of the invention can be applied to a fixing device, in which a fixing belt is suspended between a fixing roller with a heating source and a tension roller, and the fixing belt is made in contact with the sheet. As the fixing belt is rotated, the recording paper that the toner image is transcribed thereon passes the nip portion between the fixing belt and the sheet, so that the toner image is fixed on the recording paper. Furthermore, the sheet of the invention can be applied to another fixing device, in which a heating source is mounted inside a cylindrical fixing film, and the sheet is in contact with the heating source through the fixing film. By rotating the fixing film, the recording paper that the toner image is transcribed thereon passes the nip portion between the heating source and the sheet, so that the toner image is fixed on the recording paper.

According to the aforementioned structure of the invention, because the sheet is heated by a heating unit, it is possible to make the fixing device be in a fixable status quickly. In addition, when the recording paper passes the nip portion between the heat conducting unit and the sheet, the temperature of the nip portion can be prevented from being suddenly reduced. As a result, the time of starting the image recording can be reduced, and an excellent image such that the entire recording paper has no incomplete fixing portions can be obtained.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A fixing device, comprising:

a heat conducting unit, having a heating source, and being heated by the heating source; and a sheet, in contact with and pressing the heat conducting unit, wherein one end of the sheet is mounted on a fixing frame that is located at an upstream side of a transporting direction of a recording paper, and the other end of the sheet is in contact with the heat conducting unit under a pressing status, wherein when the recording paper that a toner image has been transcribed to is passed through a nip portion between the sheet and the heat conducting unit, by pressing and heating, the toner image is fixed on the recording paper, and wherein a heating unit of line shape is laid on a back surface of the sheet at a region in the vicinity of the nip portion.

2. The fixing device of claim 1, wherein the heating unit is laid parallel to a transporting direction of the recording paper.

3. The fixing device of claim 1, wherein the heating unit is laid in a grid shape.

4. An image forming device, comprising:

a fixing device, further comprising:

a heat conducting unit, having a heating source, and being heated by the heating source; and a sheet, in contact with and pressing the heat conducting unit, wherein one end of the sheet is mounted on a fixing frame that is located at an upstream side of a transporting direction of a recording paper, and the other end of the sheet is in contact with the heat conducting unit under a pressing status, and wherein when the recording paper that a toner image has been transcribed to is passed through a nip portion between the sheet and the heat conducting unit, by pressing and heating, the toner image is fixed on the recording paper, and wherein a heating unit of line shape is laid on a back surface of the sheet at a region in the vicinity of the nip portion.

5. The fixing device of claim 4, wherein the heating unit is laid parallel to a transporting direction of the recording paper.

6. The fixing device of claim 4, wherein the heating unit is laid in a grid shape.

* * * * *